US005503137A

United States Patent [19]

Fusco

[11] Patent Number: 5,503,137

[45] Date of Patent: Apr. 2, 1996

[54] CONVERSION KIT FOR A COMPRESSED GAS GUN

[75] Inventor: Bart T. Fusco, Northport, N.Y.

[73] Assignee: Pursuit Marketing, Inc., Northbrook, Ill.

[21] Appl. No.: 263,126

[22] Filed: Jun. 21, 1994

[51] Int. Cl.[6] ..... F41B 11/00

[52] U.S. Cl. ..... 124/72; 124/56; 124/73

[58] Field of Search ..... 124/56, 70–74, 124/76

[56] References Cited

U.S. PATENT DOCUMENTS

| | | | |
|---|---|---|---|
| 1,240,989 | 9/1917 | Lefever | 124/73 X |
| 3,788,298 | 1/1974 | Hale | 124/76 |
| 4,819,609 | 4/1989 | Tippmann | 124/72 |
| 4,850,330 | 7/1989 | Nagayoshi | 124/76 |
| 4,936,282 | 6/1990 | Dobbins et al. | 124/74 |
| 5,205,270 | 4/1993 | Szente | 124/50 |
| 5,349,938 | 9/1994 | Farrell | 124/73 |
| 5,349,939 | 4/1994 | Perrone | 124/76 |
| 5,383,442 | 1/1995 | Tippmann | 124/76 |

OTHER PUBLICATIONS

Two–page disclosure including Model Trracer–Parts Lists and schematic illustration of component parts listed on Parts List.

*Primary Examiner*—John A. Ricci
*Attorney, Agent, or Firm*—Rudnick & Wolfe

[57] ABSTRACT

A kit for converting a pump-action type compressed gas gun to a semi-automatic type compressed gas gun without having to change or modify an internal action of the gun and without requiring any material alterations to existing components on the gun. The kit is removably connected to the gun so that the converted semi-automatic version of the gun can readily be returned to its original pump-action type configuration and mode of operation. When the kit is used to convert the pump-action type gun to a semi-automatic type gun, the only component from the pump action type gun that is not used is the pump handle. In a preferred form of the invention, the kit includes an actuating mechanism, a gas distributing mechanism, and a activating mechanism. All the mechanisms comprising the kit of the invention are removably connected to the gun thereby allowing the gun to be returned to its original configuration and mode of operation.

23 Claims, 4 Drawing Sheets

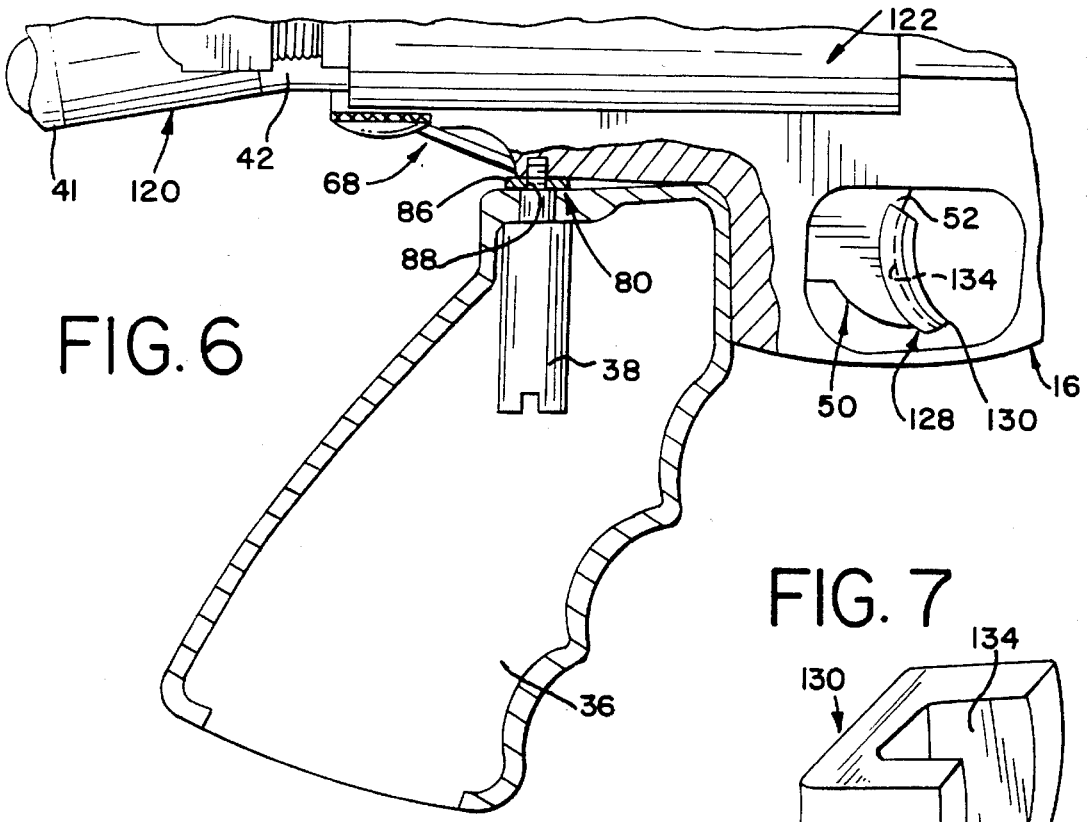
FIG. 6
FIG. 7
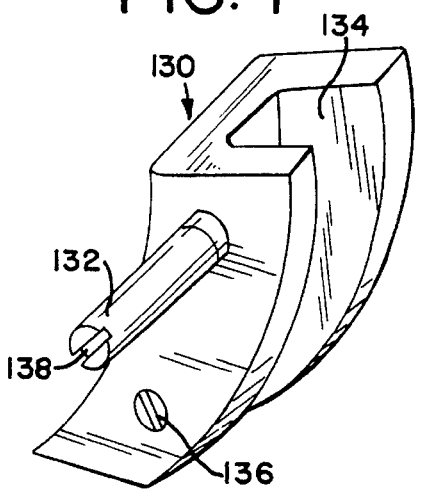
FIG. 5
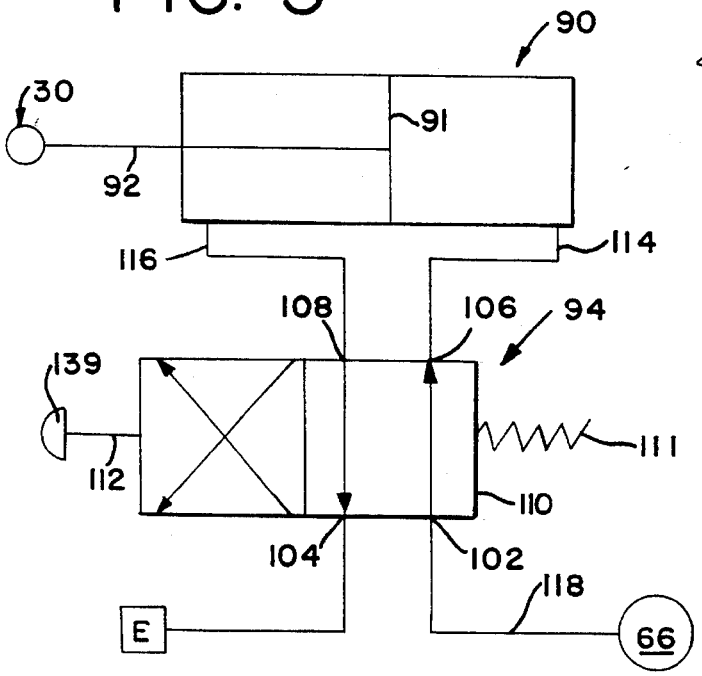

CONVERSION KIT FOR A COMPRESSED GAS GUN

FIELD OF THE INVENTION

The present invention generally relates to guns that utilize compressed gas for discharging projectiles, such as paintballs, from the gun, and, more particularly, to a kit for converting a pump-action type compressed gas gun to a semi-automatically operated compressed gas gun. The kit is removably mounted on the gun such that the gun can be readily returned to its original pump-action configuration and mode of operation upon removal of the kit.

BACKGROUND OF THE INVENTION

Guns that utilize compressed gas for firing projectiles are well known. Often these guns are used to discharge projectiles called "paintballs" which have a fragile gelatin or plastic outer coating and a liquid interior. The gelatin or plastic coating normally breaks on contact with a target.

Compressed gas guns are manufactured in a variety of shapes and sizes and have different types of internal mechanisms or actions therein. Such guns are typically powered by compressed air, carbon dioxide or nitrogen. The internal mechanism or action is housed in a receiver of the gun. A magazine for holding a plurality of paintballs is connectable to the gun. Such guns are furthermore provided with an elongated barrel which extends from the receiver and from which the projectile is discharged, and a trigger housing connected to the receiver. The trigger housing carries a trigger mechanism including a manually operated trigger for controlling the discharge of projectiles from the gun. A handle or grip is releasably connected to the trigger frame for facilitating carrying and aiming of the gun.

One common version of a compressed gas gun is a pump-action type gun. With this version of gun, manual cocking of an internal mechanism or action is an essential step that is required to prepare the gun each time a projectile is to be discharged therefrom. The internal mechanism of a pump-action type gun is manually cocked through a pump handle mounted for manual reciprocation along a lengthwise portion of the barrel. The manual pump or handle is suitably connected to the internal mechanism of the gun.

As is well known in the art, the internal mechanism or action of a pump-action type gun includes a myriad of mechanical components which cooperate with each other in response to sliding movement of the pump handle. More specifically, the internal mechanism of a pump-action type gun usually comprises a bolt, a hammer, a hammer spring, a valve tube, a valve spring and other related components. The reciprocating or back and forth sliding action of the pump handle causes the bolt and hammer of the internal mechanism to move within the receiver of the gun.

When the pump handle is slid rearwardly, the bolt is also moved rearwardly and opens a direct feed port in the receiver. Accordingly, a projectile is permitted to gravitationally drop from the magazine into the gun. The rearward sliding movement of the pump handle also moves the hammer into a cocked position. When the pump handle slides forwardly, the bolt of the internal mechanism moves therewith to position the projectile in the gun. When the bolt is fully closed, a front portion of the bolt seals the direct feed port and positions the projectile in the bore of the barrel ready for firing. Manipulation of the trigger causes the hammer of the internal mechanism to release frown its cocked position thus allowing compressed gas to pass through the internal components and forcibly discharge the projectile therefrom. The internal mechanism of the gun needs to be manually recocked before another projectile is ready to be discharged from the gun.

In contrast to the pump-action type gun, compressed gas paintball guns are also available in a semi-automatic gun version. In general, the external components of a semi-automatic type compressed gas gun are similar to those of the pump-action type gun. With this version of compressed gas gun, however, the internal mechanism is automatically cocked and the projectile is discharged from the gun simply by operating the trigger rather than having to manually cock the gun every time a projectile is to be fired therefrom. The internal mechanism or action of a semi-automatic compressed gas gun differs from that associated with a pump-action type compressed gas gun. That is, in a semi-automatic compressed gas gun, the internal mechanism or action is designed such that the cocking action of the internal mechanism is effected automatically without use of a manual pump.

Pump-action type compressed gas guns and semi-automatically operated guns each have advantages in different situations. Accordingly, different people prefer one type of compressed gun over the other. On the other hand, it is possible that some people would like to own both types of guns. As will be appreciated, however, the costs of owning a compressed gas gun can be quite high and owning more than one gun is even higher. To attempt to convert a pump-action type compressed gas gun to a semi-automatically operated version has drawbacks associated therewith. That is, convening a pump-action type gas gun to operate as a semi-automatic gun normally requires replacement of many of the component parts of the internal mechanism or action to compensate for the inability of a manual pump-action gun to cock itself. Such attempts at conversion may furthermore require machining operations and other material alterations to the gun. Of course, such material changes to the gun could prevent the gun from being returned to its original pump-action type configuration.

Thus, there is a need and a desire for a kit that allows a pump-action type compressed gas gun to be converted to a semi-automatic type gun without having to change the internal mechanism or action of the gun and without having to materially alter or perform machining operations on the gun to effect such conversion. Moreover, the conversion of the gun should be reversible such that the gun can be returned to its original pump-action type configuration.

SUMMARY OF THE INVENTION

In view of the above, and in accordance with the present invention, there is provided a kit for convening a pump-action type compressed gas gun to a semi-automatic compressed gas gun without having to change or modify the internal mechanism or action of the gun. The kit of the present invention is removably mounted to the gun so that the converted semi-automatic gun can be readily returned to its original pump-action type configuration. The conversion kit of the present invention requires no material alterations or machining of existing components of the gun including the barrel, receiver or trigger housing having a trigger mechanism and handle carried thereon. When the kit is used to convert the pump-action type gun to a semi-automatic type gun, the only component from the pump-action type gun that is not used is the pump handle.

Heretofore, compressed gas guns used a compressed gas source for a single purpose—to forcibly discharge a projectile, i.e., a paintball, from the gun. With the present invention, however, the compressed gas source is uniquely used for a dual purpose. The compressed gas is used in a conventional manner to fire a projectile from the gun in response to trigger manipulation. The kit of the present invention furthermore uses a regulated portion of the compressed gas to replace the manual pumping action of a conventional pump type gun and automatically operate the internal action of the gun whereby reciprocally moving the bolt and cocking the hammer in response to manipulation of the trigger.

The conversion kit of the present invention includes an actuating mechanism that is removably connected to the gun. The actuating mechanism replaces the need for the manual pumping action normally associated with pump type guns and serves to move the bolt and hammer of the internal action automatically in response to manipulation of the trigger. In a preferred form of the invention, a housing removably connects the actuating mechanism to the gun. The kit of the present invention also includes a gas distribution mechanism that splits the supply of compressed gas received from the compressed gas source between the actuating mechanism and the gun. That portion of the gas directed to the actuating mechanism is used to effect movement of the bolt and hammer of the internal action in response to manipulation of the trigger. That portion of the compressed gas directed to the gun is conventionally used to effect the discharge of the projectile from the gun. In the illustrated form of the invention, the kit further includes an activating mechanism removably attached to the gun for transferring movements of the trigger to the actuating mechanism that automatically controls operation of the internal action in response to trigger manipulation.

In a preferred form, the actuating mechanism includes a pneumatic cylinder carried by the housing and having a linearly distendable and retractable rod extending therefrom. The stroke of the cylinder proximates the stroke of the hand pump required to cock the internal action of a pump-action type compressed gas gun. The cylinder rod is releasably connected to the bolt of the internal action. Distention and retraction of the cylinder rod is controlled through a valve also carried by the housing. As will be appreciated, the valve directs compressed gas to the cylinder thereby regulating distention and retraction of the cylinder rod and thereby movements of the bolt and hammer of the internal action in response to trigger manipulation.

The gas distributing mechanism is removably connected between the gun and the compressed gas source. In the illustrated form of the invention, the gas distributing mechanism comprises a splitter that removably connects to an aft end of the barrel assembly. The splitter serves to direct a regulated level of compressed gas to the actuating mechanism and furthermore directs a higher level of compressed gas to the gun to effect the discharge of the projectile from the gun.

The conversion kit of the present invention is removably attached to the gun without requiring any material alterations or machining operations to the gun while using all the same internal and external components as a pump-action type compressed gas gun except for the pump handle. The housing of the kit which carries the cylinder and valve of the actuating mechanism preferably includes attachment mountings to releasably mount the actuating mechanism on the existing external components of the gun. The splitter removably mounts the gas distributing mechanism to existing hardware on the gun. Moreover, the activating mechanism is also releasably attached to the existing trigger mechanism on the gun.

Besides being readily removable from the gun, the kit is easily accessible and readily replaceable. Because the kit of the present invention is readily removable and requires no material alterations to the gun, returning the gun to a pump-action type compressed gas gun can be readily accomplished with minimum efforts and substantially no expense. Thus, the addition of the conversion kit of the present invention allows the gun to be used as either a pump-action type compressed gas gun or a semi-automatic type compressed gas gun.

Numerous other features and advantages of the present invention will become readily apparent from the following detailed description, the appended drawing and the accompanying claims.

BRIEF DESCRIPTION OF THE DRAWINGS

FIG. 5 is a schematic view of a valve and driver which are component parts of the kit of the present invention;

FIG. 6 is an enlarged side view with parts broken away to show further details of a preferred form of the present invention; and FIG. 7 is a perspective view of one form of activating mechanism forming part of the present invention.

DETAILED DESCRIPTION OF A PREFERRED EMBODIMENT

Figure 1:
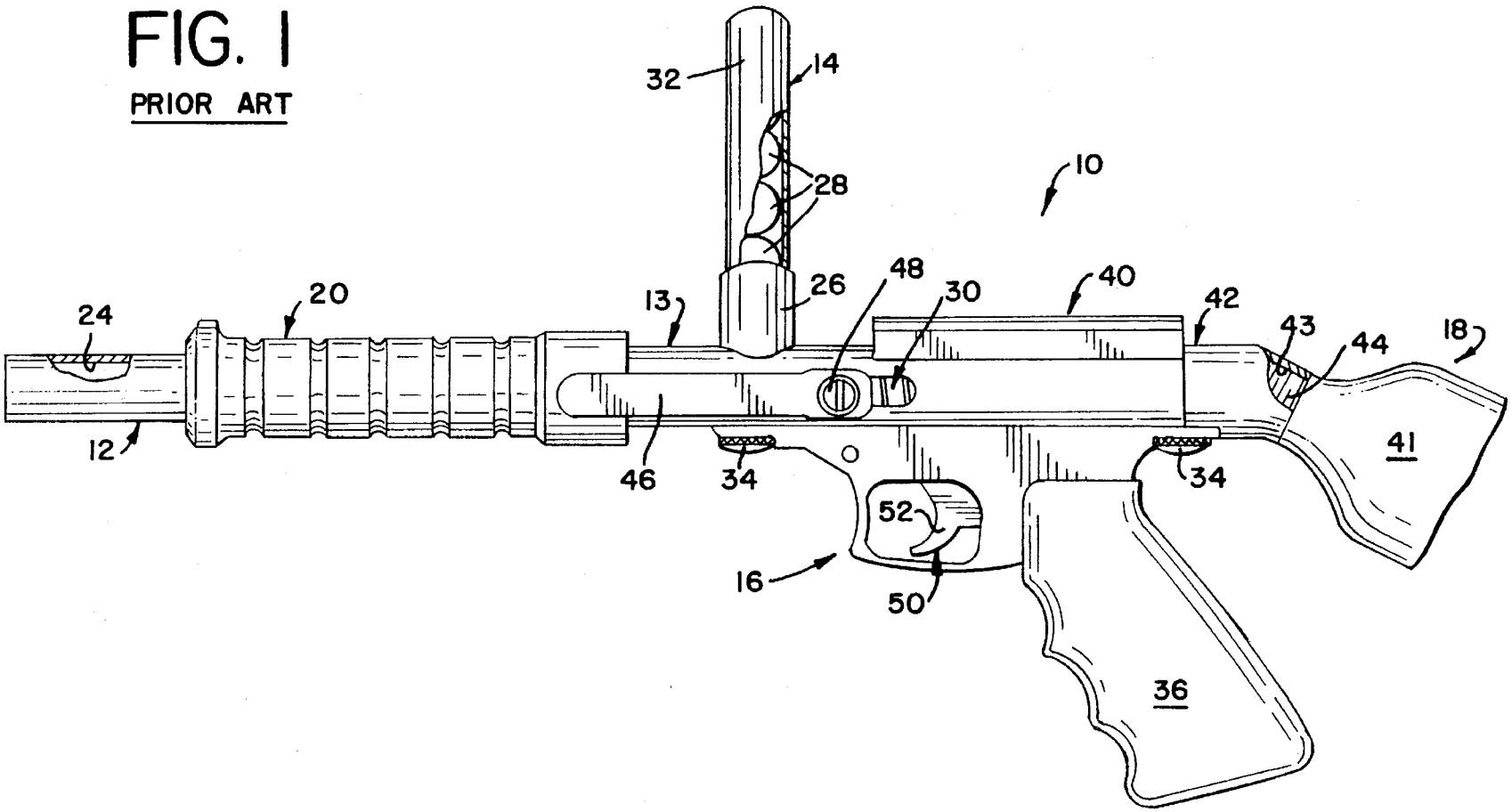
FIG. 1 PRIOR ART
FIG. 1 illustrates a pump-action type compressed gas gun.

While the present invention is susceptible of embodiment in various forms, there is shown in the drawings a presently preferred embodiment hereinafter described, with the understanding that the present disclosure is to be considered as an exemplification of one form of the invention and is not intended to limit the invention to the specific embodiment illustrated.

Referring now to the drawings, wherein like reference numerals indicate like parts throughout the several views, there is shown in FIG. 1 a pump-action type compressed gas gun 10. The compressed gas gun is preferably of the type marketed by the assignee herein as a PMI Auto Trracer™ paintball gun. It should be appreciated, however, that the present invention is equally applicable to pump-action type compressed gas guns manufactured, marketed and sold by others besides the assignee herein. A typical pump-action type compressed gas gun includes an elongated barrel 12, a receiver 13 removably connected to the aft end of the barrel 12, a magazine 14, a trigger housing 16, a compressed gas source 18, and a pump handle 20. It should be noted that these external components of the compressed gas gun 10 are removably connected to one another so that the gun can be taken apart for easy cleaning.

As shown, the barrel 12 and receiver 13 combine with each other to define an axially elongated bore 24. The receiver 13 further defines a direct feed port 26 for allowing projectiles, or paintballs 28, to be gravitationally and individually introduced into the bore 24 of the gun. A conventional and well known internal mechanism or action 30 (FIG. 1 and 4) is slidably accommodated within the receiver 13. For purposes of simplicity, the components comprising the conventional internal mechanism 30 of the compressed gas gun are not shown in the drawings. Suffice it to say, the internal mechanism or action 30 of the pump-action type gun 10 includes a myriad of cooperating and interrelated mechanical components including a bolt, a hammer, a hammer spring, a valve tube, a valve seat, a valve return spring and other related components.

The magazine 14 includes a conventional hollow housing 32 that is configured to hold multiple paintballs 28 therein. The housing 32 is releasably connected to the direct feed port 26 of the receiver 13 in a well known manner and opens to the direct feed port 26 on the receiver 13. The removable nature of the magazine 14 readily allows another magazine 14, containing more paintballs 28, to replace that magazine 14 from which paintballs 28 have been expended.

The trigger housing 16 is removably connected to an underside of the receiver 13. In the illustrated embodiment, the trigger housing 16 is removably connected to an underside of the receiver 13 by at least two frame screws 34. To facilitate handling of the gun 10, a hand grip 36 extends from a rear portion of the trigger housing 16. Preferably, the hand grip 36 has a hollow configuration and a releasable fastener 38 (FIG. 6) serves to releasably secure the hand grip 36 to the trigger housing 16.

A fore-and-aft elongated sight rail 40 is releasably connected to a top side of the receiver 13 in diametrically opposed relation from the trigger housing 16 and hand grip 36. In the illustrated embodiment, the sight rail 40 is releasably connected to an upperside of the receiver 13 as by releasable screw connectors (not shown). As is well known, the sight rail 40 is provided to allow a sight (not shown) to be releasably attached to the barrel assembly 12 to facilitate aiming of the gun 10.

As shown in FIG. 1, the compressed gas source 18 includes a conventional compressed gas tank 41. In the illustrated embodiment, tank 41 is shown as a conventional 7-ounce tank that is releasably connected to the aft end of the receiver 13 as by a conventional air source adapter 42. As known in the art, a front end of the adapter 42 is threadably connected to the aft end of the receiver 13. Suffice it to say, the adapter 42 defines, at an aft end thereof, an internally threaded chamber 43. Adapter 42 further includes a nipple (not shown) extending into chamber 43 and an air passage (not shown) leading from chamber 43 to the internal action 30 of the gun and which is normally closed by a spring valve (not shown). In a most preferred form of the invention, adapter 42 further includes suitable seals (not shown) between the adapter 42 and the receiver 13 for inhibiting pressurized gas from escaping therebetween.

As known in the art, the tank 41 has a narrowed and externally threaded male end 44 that is configured to be threadably accommodated within chamber 43 of adapter 42. As is conventional, a front end of tank 41 further includes a spring actuated core (not shown). When the tank 41 is secured to the adapter 42, the core engages with the nipple on the adapter 42 and serves to depress a pin valve (not shown) provided on the tank 41 thereby allowing compressed gas to pass from the tank 41. The pressure of the gas within the tank 41 is sufficient to open the spring biased valve acting to normally close the passage in the adapter 42 and, thus, compressed gas is introduced to aft end of the receiver 13.

The tank 41 is readily removable from the adapter 42 such that when the compressed gas is exhausted or expended, another charged tank 41 can quickly and readily replace that which is used. In a most preferred from of the invention, suitable seals (not shown) are provided between the tank 41 and the adapter 42 for inhibiting pressurized gas from escaping therebetween. The compressed gas contained within tank 41 and that which is used to power the gun can be compressed air, nitrogen or any other suitable gas that can be compressed and held within the tank 41. In a most preferred form of the invention, the pressure of the gas within tank 41 ranges between about 500 p.s.i. and about 1800 p.s.i. depending upon the type of gas compressed within the tank 41.

As shown in FIG. 1, the typical pump-action type compressed gas gun 10 has the pump handle 20 mounted for manual sliding movement along a lengthwise portion of the barrel 12 to enable manual cocking of internal action 30 of the gun 10 each time a paintball is to be fired from the gun. The pump handle 20 typically includes a pair of arms 46 that extend from one end of the handle 20. The arms 46 of the pump handle 20 extend generally parallel to one another and on opposite sides of the receiver 13. In the illustrated embodiment, the arms 46 of the pump handle 20 are releasably connected to the internal mechanism 30 of the gun as through releasable fasteners 48.

When the pump handle 20 is slid rearwardly along a lengthwise portion of the barrel 12, the bolt of the internal action or mechanism 30 is "opened". That is, when the pump handle 20 is slid rearwardly, the bolt of the internal mechanism 30 also moves rearwardly and opens the direct feed port 26 in the receiver 13. Accordingly, a paintball 28 is permitted to gravitationally drop through the feed port 26 from the magazine 14 into the gun. The rearward sliding movement of the pump handle 20 also moves the hammer of the internal mechanism 30 into a cocked position. Thereafter, the pump handle 20 is slid forwardly to "close" the bolt of the internal mechanism 30. When the bolt of the internal mechanism 30 is "closed", the paintball 28 is positioned in the bore 24 of the barrel 12 and a front portion of the bolt is positioned to seal the direct feed port 26 in the receiver 13. The gun 10 is now ready to be fired.

Firing of the compressed gas gun 10 to effect the discharge of the projectile or paintball 28 from the gun 10 is effected through manual manipulation of a well known trigger mechanism 50. The trigger mechanism 50 is mounted on the trigger housing 16 and includes a trigger 52 that is mounted in a conventional manner on the housing 16. As is well known, the trigger 52 is moved by a finger (not shown) of a person applying a force or manipulating the trigger 52 to move from its normal at-rest or released position shown in FIG. 1 to a rearwardly displaced firing position. The trigger 52 is connected to the internal mechanism 30 of the gun in a conventional fashion such that when the trigger 52 is manipulated, the hammer of the internal mechanism 30 is released from its cocked position and the relatively high pressure compressed gas provided at the aft end of the receiver 13 from tank 41 is exhausted through the internal mechanism 30 into the bore 24 of the gun and against the paintball 28 located therein. The emptying of compressed gas into the gun occurs very quickly which is sufficient to cause the paintball 28 positioned in the bore 24 of the gun to be rapidly propelled from the barrel 12.

Figure 2:
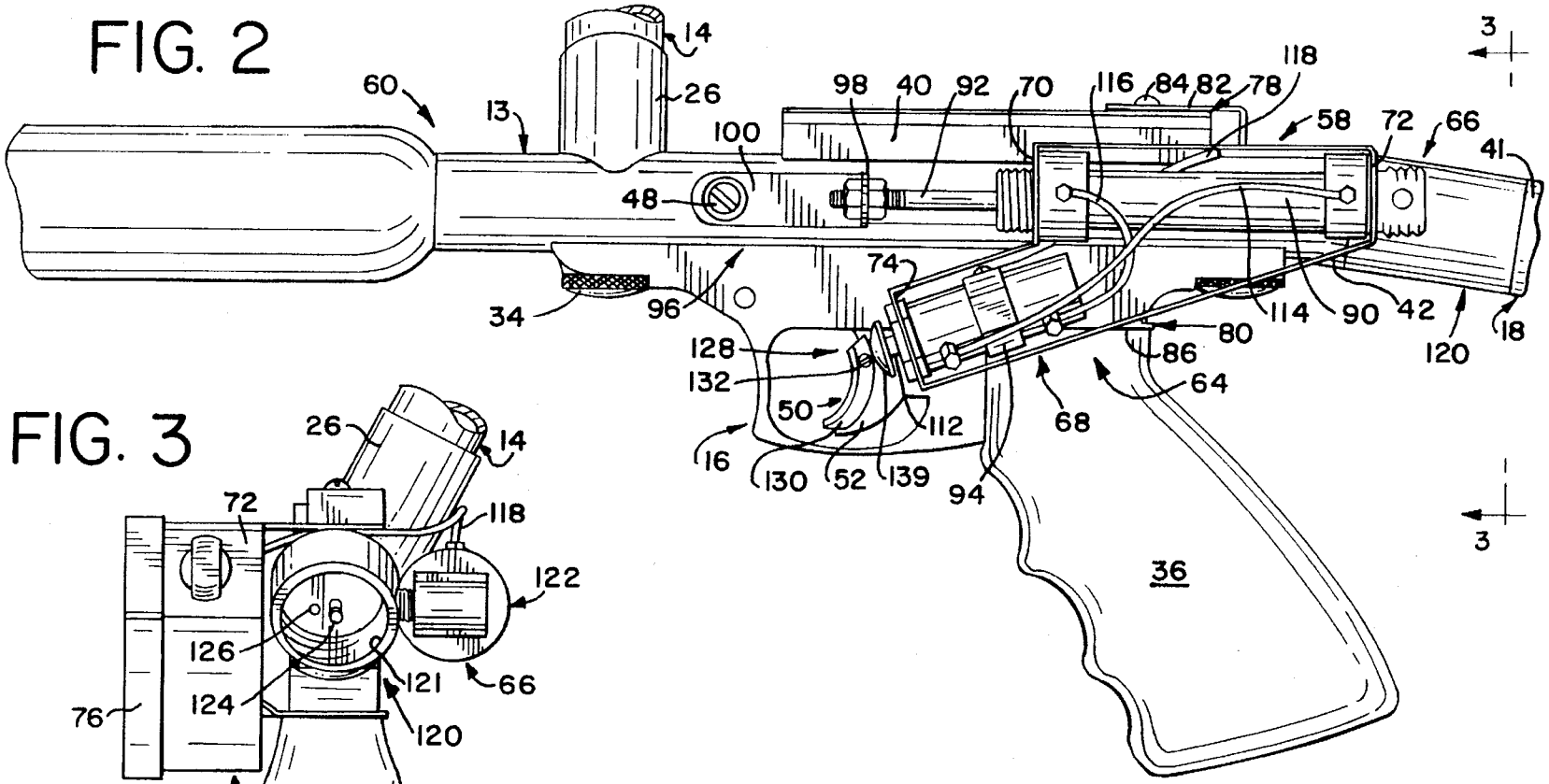
FIG. 2 is a side view, partially in section, of a conversion kit according to the present invention shown attached to the compressed gas gun illustrated in FIG. 1.
Figure 4:
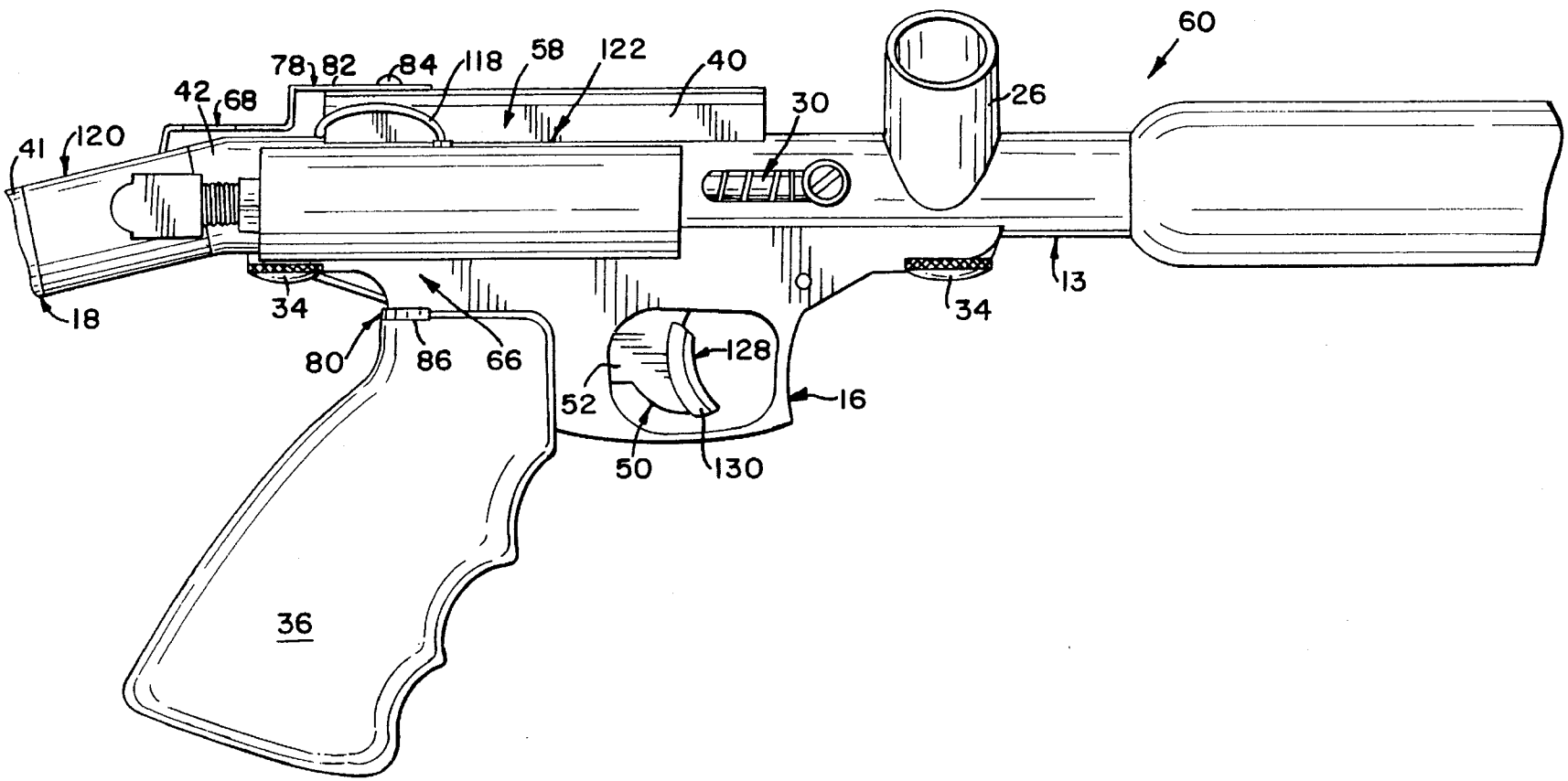
FIG. 4 is a another side view of the conversion kit of the present invention as shown attached to the compressed gas gun.

According to the present invention, and as shown in FIGS. 2 and 4, there is provided a kit 58 for converting a pump-action type compressed gas gun, similar to that represented in the drawings by reference numeral 10 and disclosed above, to a semi-automatic compressed gas gun 60 without having to change or alter the internal action or mechanism 30 of the pump-action gun 10 and requires no machining operation or other material alterations to the external components of the gun 10. Pump handle 20 is the only component from the original compressed gas pump action gun 10 that is not utilized when the kit 58 of the present invention is retrofitted to and modifies gun 10 into the semi-automatically compressed gas gun 60.

The conversion kit 58 generally includes an actuating mechanism, generally indicated by reference numeral 64, and a gas distributing mechanism, generally indicated by reference numeral 66. Mechanism 64 is preferably carried on the gun by a housing 68. Notably, the housing 68 and thereby mechanism 64 is removably and exteriorally attached to the gun such that no gun drillings are required and no material alterations are made to the gun when the kit 58 is added thereto to convert the pump-action type compressed gas gun to a semi-automatic version. Mechanism 66 is also removably attached to the gun. Removably attaching the mechanisms 64 and 66 to the gun allows the conversion kit 58 to be removed from the gun and the pump handle 20 remounted thereon whereby returning the gun to its original configuration and mode of operation. This conversion process can be repeated any number of times without an adverse impact on the gun.

In a preferred form, the actuating mechanism 64 is carried in the housing 68. Housing 68 preferably has an open interior and includes two apertured fore-and-aft spaced flanges 70 and 72 with a third apertured flange 74 being disposed beneath and in angled relation from the flanges 70, 72. All the flanges 70, 72 and 74 preferably extend away from and generally normal to the receiver 13 of the gun. A cover 76 (FIG. 3) preferably fits over and is releasably secured to the flanges of and closes the interior of the housing 68. Housing 68 further includes an upper connection element 78 and a lower connecting element 80 for removably connecting the housing 68 to the gun in a manner described in detail below.

In the illustrated embodiment, the upper connecting element 78 includes a generally horizontally disposed and rigid flange portion 82 that is provided with a suitably sized opening (not shown) to allow a releasable fastener 84 to pass therethrough. The horizontal flange portion 82 of the upper connecting element 78 is configured to fit over and extend generally parallel to the sight rail 40. The fastener 84 is adapted to pass through both the flange portion 82 of element 78 and the sight rail 40 and be releasably secured in a conventional manner in the receiver 13 as would the fastener normally used to fasten the sight rail 40 to the receiver 13. The lower connecting element 80 also includes a horizontally disposed flange portion 86. As shown in FIG. 6, the flange portion 86 of element 80 defines an open ended slot 88 for purposes to be described in detail hereinafter. The flange portion 86 of connecting element 80 has a relatively thin and rigid configuration that is adapted to be received and fit snugly between the hand grip 36 and the trigger housing 16.

Returning to FIG. 2, actuating mechanism 64 includes a double-acting gas operated cylinder 90 having an actuating rod 92 extending toward the front end of the gun and a valve 94. Cylinder 90 is mounted to and in the interior of housing 68 between horizontally aligned apertures defined by flanges 70 and 72. Rod 92 extends beyond the housing 68. Cylinder 90 is of a conventional design including a piston 91 (FIG. 5) slidable between opposite ends of the cylinder 90 and connected to the rod 92. Rod 92 extends and retracts in response to compressed gas acting on the piston 91 (FIG. 5) of the cylinder 90.

The free end of rod 92 of cylinder 90 is releasably connected to the bolt of the internal mechanism or action 30 of the gas gun. The stroke of the cylinder 90 proximates the stroke of the pump handle 20 required to cock the internal mechanism 30 of the gun. In the illustrated embodiment, a bracket 96 serves to connect the cylinder rod 92 to the internal mechanism 30 of the gun. As shown, bracket 96 has a generally L-shaped configuration including arm portions 98 and 100. Arm portion 98 of bracket 96 is connected to the rod 92 while arm portion 100 is releasably connected to the internal mechanism 30 of the gun as with the same releasable fastener 48 used to connect one arm 46 of the pump handle 20 (FIG. 1) to the internal mechanism 30 of the gun. As will be appreciated, reciprocation of the cylinder rod 92 moves the bolt and hammer of the internal mechanism 30 in a manner automatically cocking the gun for firing.

As shown, the cylinder 90 and rod 92 of actuating mechanism 68 are horizontally mounted on the gun by housing 68 to extend generally parallel to the reciprocal path of the bolt of the internal action 30 within receiver 13. Valve 94 is mounted on the gun by housing 68 to inhibit binding forces from acting thereon in response to manipulation of the trigger mechanism 50. As will be discussed below, valve 94 is responsive to manipulation of the trigger 52 of trigger mechanism 50 and according operates the actuating mechanism 64.

Valve 94 is arranged in combination with the cylinder 90 and controls reciprocation of the rod 92 thereby controlling movement of the internal mechanism 30 of the gun. As schematically represented in FIG. 5, valve 94 is preferably configured as a four-way valve that is connected between the cylinder 90 and the gas distributing mechanism 66 on the gun. Without detracting or departing from the spirit and scope of the present invention, it should be appreciated that the invention is equally applicable to a kit having a three-way valve arranged in combination with a spring biased cylinder 90.

As shown, valve 94 is mounted to and preferably within the interior of housing 68 in combination with the apertured flange 74. As schematically represented in FIG. 5, valve 94 includes an inlet port 102, an exhaust port 104, and motor ports 106 and 108. Valve 94 includes a conventional spool valve 110 that is slidably movable and positionable to control fluid communication between the ports 102, 104, 106 and 108 as a function of its linear position. In the illustrated embodiment, the spool valve 110 is biased into a predetermined position under the influence of a spring 111. Valve 94 further includes a valve stem 112 connected to the spool valve 110 and that extends beyond the housing 68 toward the trigger 52.

Motor ports 106 and 108 of valve 94 are connected to opposite ends of the cylinder 90 by suitable conduits 114 and 116, respectively. In the illustrated embodiment, the spring 111 biases the spool valve 110 such that inlet port 102 normally communicates with the motor port 106 while motor port 108 is normally open to exhaust. Motor port 106 is connected to the aft end of the cylinder 94 by conduit 114. Motor port 108 is connected to the front end of cylinder 90 by conduit 116. The inlet port 102 of valve 94 is connected to the gas distribution mechanism 66 through a suitable conduit 118, thus, normally, urging the cylinder rod 92 to an extended position thereby normally maintaining the bolt of the internal mechanism 30 in a closed position relative to the direct feed port 26 defined by the receiver 13.

Figure 3:
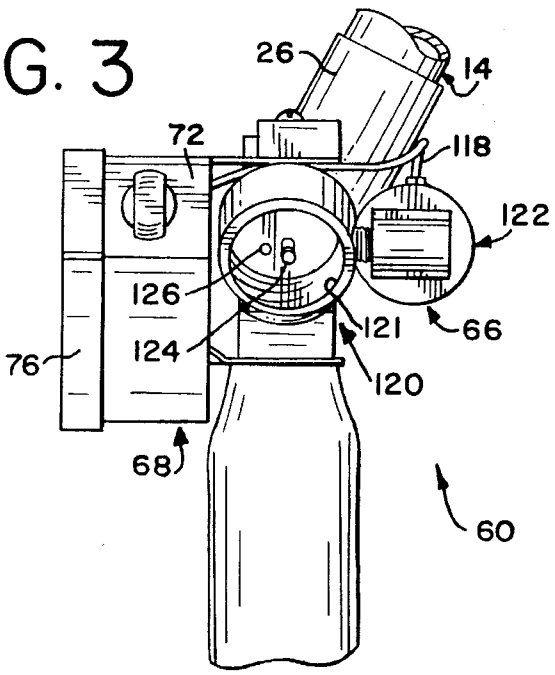
FIG. 3 is a rear view taken along line 3—3 of FIG. 2.

A preferred embodiment of the gas distributing mechanism 66 is illustrated in FIGS. 3 and 4. As shown, the gas distributing mechanism 66 includes a splitter 120 and a pressure regulator 122 that are releasably connected to the gun. As mentioned, the aft end of the adapter 42 is provided with internal threading for threadably connecting the tank 41 of the compressed gas source 18 thereto. The splitter 120 of the gas distributing mechanism 66 preferably has an externally threaded fore end that is adapted to be threadably received in the aft end of the adapter 42. The aft end of splitter 120 is further configured with internal threading 121 (FIG. 3) such that tank 41 can be releasably connected to the aft end thereof in substantially the same manner as tank 41 connects to the adapter 42. The splitter 120 is configured to allow a flow of compressed gas to be introduced from the tank 41 of source 18 to the interior of the gun in substantially the same manner as with gun 10. Suitable seals or O-rings (not shown) can be used between the splitter 120, the adapter 42 and the tank 41 of source 18 to enhance the sealing capability therebetween if so desired.

As shown in FIG. 3, the splitter 120 includes a rearwardly extending nipple 124. Nipple 124 on splitter 120 serves the same purpose as did the nipple on adapter 42. That is, when the tank 41 is connected to the splitter 120, the nipple 124 depresses the spring actuated core at the front end of tank 41. As explained above, depressing the core on the tank 41 results in the pin valve at the forward end of tank 41 being displaced so as to allow compressed gas to pass from the tank 41. Splitter 120 further defines a gas orifice 126 for directing an unregulated flow of compressed gas (ranging between about 500 p.s.i. and 1800 p.s.i.) from the tank 41 into the adapter 42 and through the passage defined therein into the interior aft end of the gun in the same manner as with the pump-action type compressed gas gun 10.

The gas orifice 126 also allows pressurized gas direct from tank 41 to pass to the pressure regulator 122. Thus, the splitter 120 serves to direct compressed gas to both the gun and to the pressure regulator 122. In the illustrated embodiment, the pressure regulator 122 is connected to the splitter 120. It will be appreciated, however, that the splitter 120 and regulator 122 could be redesigned as a single unit or the regulator 122 could be connected through other suitable conduits to the splitter 120. The purpose of the pressure regulator 122 is to receive a relatively high pressurized gas from source 18 and provide a regulated flow of reduced pressurized gas to the actuating mechanism 64 as through conduit 118. In the illustrated embodiment, the reduced flow of pressurized gas to the actuating mechanism 64 is regulated by the pressure regulator 122 to be in the range of about 25 p.s.i. to about 100 p.s.i. when compressed air is used in the tank 41.

In a preferred embodiment of the invention, and as illustrated in FIGS. 2 and 4, the conversion kit 58 of the present invention further includes an activating mechanism 128 for transferring movement of the trigger 52 to the actuating mechanism 64. In the illustrated embodiment, the activating mechanism 128 includes a trigger shoe 130 and an adjustable rod 132 extending laterally from one side of the shoe 130. The trigger shoe 130 is configured for releasable attachment to the trigger 52 of the trigger mechanism 50 on the gun.

As shown in FIGS. 6 and 7, the trigger shoe 130 preferably has an elongated slot or channel 134 extending along a rear side thereof for accommodating a lengthwise portion of the trigger 52. When the activating mechanism 128 is removably attached to the gun, the trigger 52 fits within the slot or channel 134 and the shoe 130 preferably surrounds a lengthwise portion of and moves with the trigger 52. In the illustrated embodiment, releasable fasteners such as screws 136 releasably secure the shoe 130 to the trigger 52 so that the shoe 130 can later be removed from or adjusted relative to the trigger 52 if and when the need arises. As will be appreciated, other means of releasably attaching the shoe 130 to the trigger 52 could likewise be used without departing or detracting from the spirit and scope of the present invention.

As shown in FIG. 7, the rod 132 extends laterally from the shoe 130 and preferably has an outer generally cylindrical surface configuration extending along the length thereof. Moreover, rod 132 is laterally adjustable relative to the trigger shoe 130. A screw-like slot 138 at the free end of the rod 132 facilitates endwise movement of the rod 132 relative to shoe 130.

As will be appreciated, when the trigger 52 of the trigger mechanism 50 is manipulated, the trigger shoe 130 and rod 132 move therewith to engage the free end of and move the valve stem 112 on the valve 94 of the actuating mechanism 64. Thus, manipulating movement of the trigger 52 results in positioning movements of the spool valve 110 connected to the valve stem 112 thereby controlling the flow of compressed gas between the gas distributing mechanism 66 and the actuating mechanism 64.

As mentioned above, the valve 94 is mounted on the gun by the housing 68 to extend at an angle relative to the cylinder 90 and such that the spool valve 110 and valve stem 112 are readily moved in response to manipulation of trigger 52. To facilitate the transfer of arcuate movement of the trigger 52 into linear positional movements of the valve 74, the free end of the valve stem 112 is provided with a relatively large head portion 139 having an outer generally semi-spherical surface configuration whereat the head portion 139 is adapted to engage the outer surface configuration on the rod 132 of the activating mechanism 128.

A mode of operation of the illustrated form of the invention will now be described. Before the pump-action type compressed gas gun 10 can be used as a semi-automatic type compressed gas gun 60, the conversion kit 58 of the present invention must be installed on the gun. Prior to installing the kit 58, tank 41 is removed from the aft end of the receiver 13 and no paintballs 28 should be present in the bore 24 of the gun. Unfastening the fasteners 48 will allow the pump handle 20 to be unfastened from the internal mechanism 30 and removed from the gun 10. The pump handle 20 should be stored in a safe place so that the gun can be returned to its original configuration when desired by the user thereof.

The gas distribution mechanism 66 is releasably connected to the gun as by the splitter 120 being threadably connected to the aft end of the adapter 42. 0-rings (not shown) minimize leakage of pressurized gas between the splitter 120 and the adapter 42. After the splitter 120 is secured to the aft end of the adapter 42, tank 41 can be reconnected to the gun as by securing the forward end of the tank 41 to the aft end of the splitter 120 in substantially the same manner as if the tank 41 were being connected to the adapter 42. Again, O-tings disposed between the splitter 120 and the tank 41 will minimize leakage of pressurized gas therebetween.

In the illustrated embodiment, the activating mechanism 128 is also releasably connected to the gun as by releasably connecting the shoe 130 to the trigger 52 of the trigger mechanism 50. As shown, the releasable fasteners 136 releasably secure the shoe 130 to the trigger 52. The rod 132 laterally extends from the shoe 130 to that side of the gun whereupon the actuating mechanism 64 is to be removably mounted.

Housing 68 releasably secures the actuating mechanism 64 to the gun such that the actuating mechanism 64 and the rod 132 of the activating mechanism 128 can be arranged in cooperative relation relative to each other. In the illustrated embodiment of the invention, the housing 68 is secured to the gun by inserting the flange portion 86 of the lower connecting element 80 on the housing 68 between the hand grip 36 and the trigger housing 16. Sufficient space is provided between the hand grip 36 and the trigger housing 16 as by loosening the fastener 38 that secures the hand grip 36 to the trigger housing 16. It should be appreciated that the open ended slot 88 in the flange portion 86 allows the connecting element 80 to be fitted about and without requiring removal of the fastener 38 from the trigger housing 16. In the illustrated embodiment, access to the fastener is effected as through the hollow hand grip 36.

As shown, stability is provided to the housing 68 and the actuating mechanism 64 carried thereby by releasably securing the upper connecting element 78 to the upper or top side of the receiver 13. In the illustrated embodiment, the vertical spacing between the upper and lower connecting elements 78 and 80, respectively, is such that when the lower connecting element 80 is fastened between the hand grip 36 and the trigger housing 16, the apertured flange portion 82 of the upper connecting element 78 lies parallel to and extends over the sight rail 40. As such, the fastener 84 releasably secures the upper connecting element 78 to the top or upper side of the receiver 13.

The cylinder 90 of the actuating mechanism 64 is securely mounted between the flanges 70 and 72 of the housing 68. The piston rod 92 of cylinder 90 extends through and is secured to the internal mechanism 30 of the gun forwardly of the flange 70 on housing 68. Preferably, bracket 96 acts in combination with the fasteners 48 for releasably securing the free end of cylinder rod 92 to the internal mechanism 30 of the gun. When the components of the actuating mechanism 64 and activating mechanism 128 are properly secured to the gun, the rod 132 of the activating mechanism 128 engages the head portion 139 on the valve stem 112 extending from spool valve 110 of valve 74. If the relationship between the rod 132 and the head portion 138 on the valve stem 112 requires adjustment, the fasteners 136, releasably securing the shoe 130 to the trigger 52 of the trigger mechanism 50, can be loosened to promote adjustment of the activating mechanism 128 until the proper relationship is established between the rod 132 and the valve stein 112 of the actuating mechanism 64. After the activating mechanism 66 is properly adjusted, the fasteners 136 are tightened to secure the shoe 130 to the trigger 52 of the trigger mechanism 50.

Releasably connecting the kit 58 of the present invention to the gun, allows the pumpaction type gun shown in FIG. 1 to be operated as a semi-automatic compressed gun although the internal action or mechanism 30 of the gun has not been changed and no gun drilling operations have been performed on the gun. When the compressed gas source 18 is operably associated with the gun, the splitter 120 distributes relatively high compressed gas (about 600 p.s.i. when compressed air is used in tank 41) both to the interior of the gun for propelling a paintball from the barrel 12 and to the pressure regulator 122. A regulated flow of compressed gas (approximating 25 p.s.i. to about 100 p.s.i. when compressed air is used in tank 41) passes from the pressure regulator 122 to the inlet port 102 of valve 94 as through conduit 118.

The addition of the kit 58 to the gun allows both a paintball 28 to be automatically introduced and positioned within the bore 24 while also effecting automatic cocking of the internal action or mechanism 30 of the gun simply by manipulating the trigger 52 of the trigger mechanism 50 rather than through manual reciprocation of the pump handle 20. When the trigger 52 is pulled rearwardly, the rod 132 of the activating mechanism 128 moves rearwardly therewith and, through the head portion 139, linearly moves the valve stem 112 thereby positioning the spool valve 110 against the action of spring 111 of valve 94. That is, when the trigger 52 is pulled rearwardly toward a firing position, the valve stem 112 moves and positions the spool valve 110 of valve 94. With the spool valve 110 in a displaced position, the regulated flow of compressed gas delivered to valve 94 through conduit 118 from the pressure regulator 122 passes from the inlet port 102 of valve 94 to the motor port 108 and through the conduit 116 to the forward end of the cylinder 90 causing the cylinder rod 92 to retract and thereby moving the bolt and the hammer of the internal mechanism 30 rearwardly therewith. As will be appreciated, and with the spool valve 110 being linearly displaced, the rear end of the cylinder 90 is exhausted through port 104.

The rearward movement of the bolt of the internal mechanism 30 "opens" the direct feed port 26 in the receiver 13 and allows a paintball 28 to gravitationally fall through the port 26 into the bore 24 of the gun. The rearward movement of the internal mechanism 30 also moves the hammer of the internal action or mechanism 30 into a cocked position.

Upon the release of the trigger 52, a conventional spring (not shown) associated with the trigger mechanism 50 returns the trigger 52 to its normal at-rest position. Simultaneously, the spring 111 returns the spool valve 110 to the position shown in FIG. 5. With the valve 94 in the position shown in FIG. 5, the inlet port 102 is again connected to the aft end of the cylinder 90 through the spool valve 112 and the conduit 114. Moreover, the forward or front end of the cylinder 90 is again connected to the exhaust port 104. As such, compressed gas provided to valve 94 through the conduit 118 is directed to the aft end of the cylinder 90 causing the rod 92 to extend forwardly and thereby forwardly moving the bolt of the internal mechanism 30 therewith. When the bolt moves forwardly, it "closes" the direct feed port 26 in the receiver 13 and positions the projectile, i.e., paintball 28, within the bore 24 of the gun. Thus, the compressed gas gun is now ready to be fired.

When the paintball 28 is to be discharged from the gun, the trigger 52 of the trigger mechanism 50 is again pulled. As is conventional, the manipulation of the trigger 52 causes the hammer of the internal action mechanism 30 to release from its cocked position thus allowing the unregulated and relatively high pressure compressed gas to pass through the gun and against the paintball 28 thereby propelling the paintball 28 from the barrel 12 of the gun. Manipulation of the trigger 52, of course, causes the actuating mechanism 64 of the kit 58 to automatically move the internal mechanism 30 in the manner discussed above whereby automatically introducing another paintball 28 into the bore 24 of the gun while also automatically cocking the gun as described above.

It should be understood that the pressure regulator 122 regulates the pressurized gas delivered to the actuating mechanism 164 with substantially less pressure than that used to propel the paintball 28 from the gun. Accordingly, the paintball 28 will be discharged from the barrel 12 before the actuating mechanism 64 automatically moves the internal mechanism 30 of the gun to allow another paintball 28 to be introduced into the bore 24 and the hammer of the internal mechanism 30 being cocked.

With the present invention, the kit 58 is retrofittable to pump-action type guns thereby modifying such guns into semi-automatic compressed gas guns without having to change or alter the internal action or mechanism 30 of the gun and without having to make material alterations to the gun. Accordingly, if the user wants to return the gun from its semi-automatic operation to a pump-action type compressed gas gun, the kit 58 of the present invention is simply removed therefrom and the gun is returned to its original configuration after the pump handle 20 is added thereto. Thus, the use of kit 58 readily allows the gun to be used as either a pump-action type compressed gas gun 10 or a semi-automatic type compressed gas gun 60.

From the foregoing, it will be observed that numerous modifications and variations can be effected without departing from the spirit and scope of the present invention. It will be appreciated that the present disclosure is intended as an exemplification of the invention, and it is not intended to limit the invention to the specific embodiment illustrated. The disclosure is intended to cover by the appended claims all such modifications as fall within the spirit and scope of the claims.

What is claimed is:

1. A removable kit for converting a pump-action type compressed gas gun to a semi-automatic type gun without changing an internal mechanism of the gun, said pump-action type gun having a receiver, with the internal mechanism of the gun including a bolt that reciprocally moves within the receiver, a barrel from which a projectile is forcibly discharged, and a trigger mechanism arranged in operable association with the internal mechanism, said trigger mechanism including a trigger that is normally retained in a released position and that is manually movable to a firing position, and wherein said internal mechanism is responsive to said trigger being moved between said released position and said firing position to allow compressed gas to pass into said receiver to forcibly project said projectile from said barrel, said kit comprising:

an actuating mechanism connected to and for automatically moving the bolt of said internal mechanism in response to said trigger being moved between said released position and said firing position;

a gas distributing mechanism for directing compressed gas between said gun and said actuating mechanism such that the compressed gas directed to said gun discharges a projectile in said receiver from said gun in response to said trigger being moved between said released position and said firing position and such that the compressed gas directed to said actuating mechanism enables said actuating mechanism to move the bolt of said internal mechanism within the receiver to allow another projectile to be inserted into said receiver; and wherein said actuating mechanism and said gas distributing mechanism are removably connected to said gun such that said actuating and said gas distributing mechanisms can be removed from the gun thereby allowing the gun to be readily returned to said pump-action type compressed gas gun.

2. The removable conversion kit according to claim 1 further comprising:

a housing for removably connecting said actuating mechanism to said gun; and a mounting for removably connecting said gas distribution mechanism to said gun.

3. The removable conversion kit according to claim 2 wherein said housing comprises:

an upper connection element for connecting said housing to an upper side of said receiver and a lower connection element for removably connecting said housing to a lower side of said receiver.

4. The conversion kit according to claim 1 wherein said actuating mechanism comprises:

a pneumatic cylinder with an endwise reciprocal rod extending therefrom;

a connecting mechanism for releasably connecting a free end of said rod to said internal mechanism; and a valve for distributing compressed gas to said cylinder, said valve being responsive to movement of said trigger between released and firing positions.

5. The conversion kit according to claim 4 wherein said valve is a four-way valve.

6. The conversion kit according to claim 4 wherein said cylinder is a double-acting pneumatic cylinder.

7. The conversion kit according to claim 1 further comprising:

an activating assembly arranged between said trigger and said actuating mechanism, said activating assembly being responsive to movement of said trigger.

8. The conversion kit according to claim 7 wherein said activating assembly comprises:

a shoe removably attached to the trigger of said trigger mechanism and movable therewith; and a rod carried by said shoe for operating said actuating mechanism in response to movement of said trigger.

9. The conversion kit according to claim 1 wherein said gas distributing mechanism comprises:

a splitter removably connected toward an aft end of said receiver between a compressed gas source and said internal mechanism for distributing compressed gas between said the internal mechanism of the gun and said actuating mechanism; and a pressure regulator for receiving compressed gas from said splitter and directing compressed gas to said actuating mechanism at a predetermined pressure level.

10. The conversion kit according to claim 9 wherein said pressure regulator distributes compressed gas at a greater pressure to said internal mechanism within said gun than to said actuating mechanism.

11. The conversion kit according to claim 1 wherein said projectiles being paintballs discharged from said weapon.

12. A kit for converting a pump-action type paintball gun that uses compressed gas for forcibly discharging a paintball from the gun to a semi-automatic type compressed gas paintball gun, said pump-action type paintball gun having an elongated barrel and a receiver with a magazine of paintballs connectable to said receiver, said receiver being configured at an aft end for releasable association with a compressed gas source and said barrel having a distal end from which a paintball is discharged, a mechanism arranged internally and between opposite ends of said receiver, and a movable trigger for controlling the discharge of paintballs from said gun, said kit comprising:

an actuating mechanism for automatically operating said internal mechanism in response to trigger manipulation such that a paintball is permitted to be loaded into said gun from said magazine and positioned within said barrel in response to movement of said trigger;

a gas distributor mechanism removably connected to said gun for simultaneously supplying compressed gas to said gun to forcibly discharge a paintball loaded and positioned in said barrel from the distal end of the receiver in response to manipulation of the trigger and to said actuating mechanism whereby automatically and timely operating said internal mechanism to allow another paintball to be loaded into said barrel from said magazine in response to manipulation of the trigger; and a housing for removably mounting the actuating mechanism to the gun.

13. The conversion kit according to claim 12 wherein said actuating mechanism comprises:

a double-acting pneumatic cylinder with a reciprocating rod extending from one end thereof;

structure for releasably connecting said cylinder rod to the internal mechanism of the gun such that said actuating mechanism operates said internal mechanism to permit a paintball to be admitted into and positioned for discharge from the gun in response to reciprocation of the rod of said cylinder; and a valve having a valve spool, said valve being connected between said cylinder, said trigger mechanism, and said gas distributor mechanism, and wherein said valve spool moves in response to manipulation of said trigger mechanism thereby directing compressed gas between said gas distributor mechanism and said cylinder.

14. The conversion kit according to claim 13 wherein said valve is a four-way valve.

15. The conversion kit according to claim 12 further comprising:

an activating assembly removably connected between said trigger mechanism and said actuating mechanism, said activating assembly being responsive to movement of said trigger mechanism to actuate said actuating mechanism and discharge said weapon.

16. The conversion kit according to claim 15 wherein said activating mechanism comprises:

a shoe removably connected to said trigger mechanism and moving therewith; and a rod connected to said shoe and moving therewith to actuate said actuating mechanism.

17. The conversion kit according to claim 12 wherein said gas distribution mechanism comprises:

a gas splitter removably connected between said compressed gas source and said receiver; and a pressure regulator carried by said splitter for directing compressed gas at a predetermined pressure level to said actuating mechanism.

18. A removable kit for converting a pump-action type gun that uses compressed gas to discharge a projectile from said gun to a semi-automatically operated gun, said pump-action type gun including a barrel connected to a fore end of a receiver, said receiver defining a direct feed port through which a paintball is inserted into a bore of the gun, a compressed gas source releasably connected to the aft end of the receiver, a trigger guard frame removably attached to an underside of the receiver and having a handle releasably connected thereto to facilitate aiming and holding of the gun, a sight mounting releasably connected to said receiver in diametrically opposed relation relative to said trigger guard frame, a trigger mechanism including a movable trigger carried by said frame for movement between a released position and a firing position, and an internal mechanism operably connected and responsive to said trigger to allow compressed gas to pass into said receiver to forcibly project a paintball from said barrel, said internal mechanism including a bolt reciprocally arranged within the receiver for movement between a forwardly cocked position wherein the bolt positions a paintball in the bore of the gun for discharge and closes the direct feed port defined by the receiver and a rearward position wherein the bolt is positioned in the receiver and relative to the direct feed port to allow a paintball to be inserted through the feed port into said bore, said kit comprising:

a gas operated actuating mechanism connectable to and for automatically moving the bolt of said internal mechanism within the receiver in response to movement of said trigger between said released position and said firing position;

a gas distributor mechanism connectable between said compressed gas source and the aft end of said receiver for simultaneously directing compressed gas to said gun for the purpose of discharging a paintball from the bore of the gun and to said actuating mechanism for moving said bolt within the receiver of the gun;

an activating mechanism connected to said trigger for operating said actuating mechanism in response to movement of said trigger between the released position and said firing position; and wherein said actuating mechanism, said activating mechanism and said gas distributor mechanism are all removably connected to said gun to allow said gun to be converted between a pump-action type compressed gas gun and a semi-automatically operated compressed gas gun that utilize the same internal mechanism for discharging paintballs from the bore of the gun.

19. The conversion kit according to claim 18 wherein said actuating mechanism comprises:

a double-acting pneumatic cylinder with a reciprocal rod extending therefrom and removably connected to said internal mechanism;

a valve having a valve stem at least a portion of which extends exteriorally from said valve, and wherein said valve is connected between said gas distribution mechanism and said cylinder for directing compressed gas therebetween; and wherein said valve stem is engaged by and moves in response to movement of said activating mechanism thereby positioning said valve to direct compressed gas from said compressed gas source to said cylinder to operate said actuating mechanism.

20. The conversion kit according to claim 18 wherein said activating mechanism comprises:

a trigger shoe removably attached to said trigger; and a rod connected to and extending from said shoe so that said actuating mechanism is responsive to movement of said trigger mechanism.

21. The conversion kit according to claim 18 wherein said gas distributor mechanism comprises:

a splitter removably connected between said compressed gas source and said barrel; and a pressure regulator connected to said splitter and said actuating mechanism;

wherein said splitter distributes compressed gas between said actuating mechanism and said internal mechanism and said pressure regulator distributes said compressed gas between said actuating mechanism and said internal mechanism at a predetermined level so that said gun can discharge one of said projectiles from said bore and insert another projectile into said bore from said magazine.

22. The conversion kit according to claim 18 further comprising:

a housing for removably connecting said actuating mechanism to said gun;

wherein said housing includes an upper connecting element and a lower connecting element for removably connecting said housing to said gun, wherein said upper connecting element removably connects the housing to said sight mounting and said lower connecting element removably connects the housing between said handle and said trigger guard frame.

23. In combination with a compressed gas gun having an elongated barrel and a receiver from which a paintball is forcibly discharged under the influence of compressed gas in response to manipulation of a trigger mechanism mounted on the gun, an internal mechanism within said receiver that is required to be cocked whereby allowing a paintball to be admitted into and positioned for discharge from a bore of the gun in response to trigger manipulation, a kit for allowing the gun to be converted for use as either a pump-action type gun requiring manual cocking of the internal mechanism of the gun or as a semi-automatically operated gun that automatically cocks the internal mechanism of the gun in response to trigger manipulation, said kit comprising:

a manual pump handle that slidably fits over and is guided for sliding movement along the barrel, said pump handle being releasably connectable to said internal mechanism such that sliding movement of the handle effects cocking of the gun;

a gas operated mechanism that is releasably mountable on the gun and which is releasably connectable to the internal mechanism of the gun, said gas operated mechanism being connected to a compressed gas source carried on the gun and includes a valve that operates a driver releasably connected to the internal mechanism of the gun, and wherein said valve is responsive to manipulation of the trigger such that said driver operates said internal mechanism in response to manipulation of the trigger;

wherein the gun is adaptable for use as either a pump-action type compressed gas gun when the pump handle is mounted on the barrel and releasably connected to the internal mechanism or is operational in a semi-automatic mode of operation when the gas operated mechanism replaces the pump handle and is connected to and automatically cocks the internal mechanism of the gun in response to trigger manipulation.

* * * * *